US005538272A

United States Patent [19]

Peart

[11] Patent Number: 5,538,272

[45] Date of Patent: Jul. 23, 1996

[54] TUNABLE SNOWBOARD

[76] Inventor: Stephen Peart, 21116 Locust Dr., Los Gatos, Calif. 95031

[21] Appl. No.: 215,495

[22] Filed: Mar. 21, 1994

[51] Int. Cl.[6] ..... A63C 5/03; A63C 5/048; A63C 5/056; A63C 5/12

[52] U.S. Cl. ..... 280/602; 280/610; 280/14.2; 280/608

[58] Field of Search ..... 280/602, 607, 280/608, 609, 610, 14.2

[56] References Cited

U.S. PATENT DOCUMENTS

| | | | |
|---|---|---|---|
| D. 308,711 | 6/1990 | Katz . | |
| D. 308,996 | 7/1990 | Katz . | |
| 1,858,120 | 5/1932 | Stevens | 280/607 |
| 2,065,179 | 12/1936 | Fosse | 280/610 |
| 3,437,345 | 4/1969 | Berta . | |
| 3,834,250 | 9/1974 | Fonas | 280/815 X |
| 4,165,091 | 8/1979 | Chadwick . | |
| 4,592,567 | 6/1986 | Sartor | 280/602 |
| 4,721,020 | 1/1988 | Stumpf | 76/83 |
| 4,778,710 | 10/1988 | Deutsch | 280/608 X |
| 4,818,839 | 4/1989 | Chastain | 219/76.14 |
| 4,838,571 | 6/1989 | Sevington | 280/608 |
| 4,850,252 | 7/1989 | Sewell | 76/83 |
| 4,884,343 | 12/1989 | Sewell | 30/169 |
| 4,895,388 | 1/1990 | Richmond | 280/602 X |
| 4,915,400 | 4/1990 | Chambers . | |
| 4,951,960 | 8/1990 | Sadler . | |
| 4,974,868 | 12/1990 | Morris . | |
| 5,044,656 | 9/1991 | Peyre . | |
| 5,085,455 | 2/1992 | Bogner et al. . | |
| 5,092,618 | 3/1992 | Mayr | 280/602 |
| 5,135,249 | 8/1992 | Morris . | |
| 5,462,304 | 10/1995 | Nyman | 280/14.2 X |

FOREIGN PATENT DOCUMENTS

| | | | |
|---|---|---|---|
| 170377 | 2/1952 | Austria | 280/608 |
| 214326 | 3/1961 | Austria | 280/607 |
| 746385 | 11/1966 | Canada | 280/608 |

*Primary Examiner*—Brian L. Johnson
*Attorney, Agent, or Firm*—Kolisch, Hartwell, Dickinson, McCormack & Heuser

[57] ABSTRACT

A tunable snowboard having a base with perimetric edge tunability so that the controlling edge can be formed to meet the specific needs of the end user. The tunability is provided by a sheet of tunable material that covers some or all of the base. The amount of the base that is covered with tunable material in any one part of the snowboard is selected based on how much adjustment is to be provided in that part. A method for making a snowboard is also disclosed, including providing tunable material in the approximate shape of a snowboard. The tunable material is shaped to cover preferably from 10-percent to 100-percent of the base of the finished snowboard and a deck of structural material is bonded to the tunable material. In addition, the method can include cutting a hole in the tunable material adjacent an end of the snowboard and then extruding a portion of the deck material through the hole, and molding indentations, a step plate pattern and binding mounting plate patterns into the deck.

16 Claims, 2 Drawing Sheets

TUNABLE SNOWBOARD

FIELD OF THE INVENTION

This invention relates generally to a device for travelling over snow, and more particularly to a snowboard for travelling downhill on snow.

BACKGROUND ART

Traditional snowboards are made from non-tunable structural material, with a controlling edge being provided by adhering a narrow, fixed-width band of metal along the sides of the snowboard. Thus only a very limited amount of tunability is provided, and the shape of the snowboard is fixed in the manufacturing process. No user reshapability is provided, nor is machine reshapability provided. In addition, the base must be waxed and sanded to provide a proper surface for sliding on the snow.

SUMMARY OF THE INVENTION

The present invention is a tunable snowboard in which the base of the snowboard has a perimeter that can be formed to meet the specific needs of the end user. Thus, the snowboard has a traveling surface with perimetric edge tunability. The controlling edge substantially resists wear and tear and can be repeatedly reshaped and resharpened to redefine the perimeter of the traveling surface. This tunability is provided by a sheet of tunable material from which the snowboard is partially formed, and that covers some or all of the base. The amount of the base that is covered with tunable material in any one part of the snowboard is selected based on how much adjustment is to be provided in that part.

Another aspect of the present invention involves a method for making a snowboard, including providing tunable material in the approximate shape of a snowboard. The tunable material is shaped to cover preferably from 10-percent to 100-percent of the base of the finished snowboard. A deck of structural material is bonded to the tunable material. In addition, the method can include cutting a hole in the tunable material adjacent an end of the snowboard and then extruding a portion of the deck material through the hole, and molding indentations, a step plate pattern and binding mounting plate patterns into the deck.

It is an object of this invention to provide a snowboard having perimetrical edge tunability.

It is another object of this invention to form a snowboard from a sheet of tunable material bonded to a deck of structural material.

It is a further object of this invention to reinforce selectively the deck of a snowboard with spaced elongated indentations.

DETAILED DESCRIPTION OF THE PREFERRED EMBODIMENT

Figure 2:
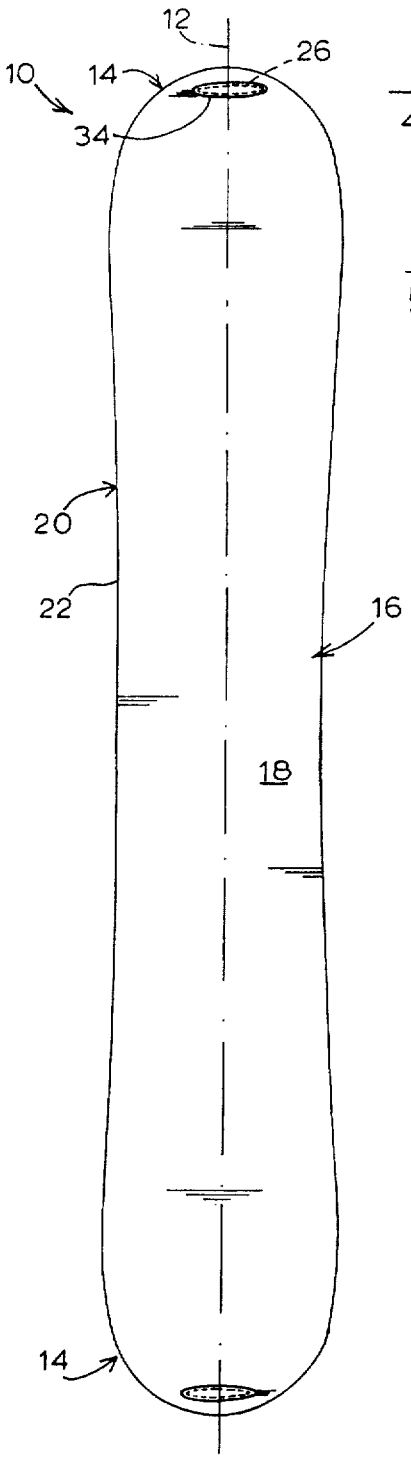
FIG. 2 is a bottom plan view of the snowboard shown in FIG. 1.

Referring to FIGS. 1 through 5, the preferred embodiment of the snowboard of the present invention is shown generally at 10. The finished snowboard 10, also referred to as a tunable snowboard 10 for reasons to be explained below, is elongate in shape, and has a long axis indicated generally at 12. Snowboard 10 has ends 14 which are upturned to form a shovel at each end 14. A base 16 is shown having a surface area defined by a bottom 18. Bottom 18 can also be referred to as a travelling surface or the exposed surface of base 16.

Bottom 18 has an outer perimeter 20 defined by an edge 22. In the preferred embodiment, base 16 is made of a tunable material 24, tunable material being any material that can be shaped to have an edge capable of providing grip on snow and ice. Thus, perimeter 20 is the controlling edge for snowboard 10. Preferably, material 24 can be repeatedly reshaped and resharpened, so that when material 24 is substantially coextensive with perimeter 20, perimeter 20 can be substantially redefined by reshaping material 24. For instance, perimeter 20 may be reshaped to have a different side-cut radius. An example of tunable material is metal, such as chrome plated steel or stainless steel, and the preferred material 24 is 0.012-inch brushed stainless steel. In alternative embodiments, material 24 ranges from 0.005-inches to 0.035-inches in thickness. The use of metal for material 24 means that no waxing or sanding of base 16 is required. Furthermore, the reshaping and resharpening of base 16 can be done with hand tools or with machines, and the snowboard is inexpensive to make. In the preferred embodiment, a hole 26, preferably oval shaped, is provided in material 24 near each end of the finished snowboard 10.

Snowboard 10 also has a deck 28 that is attached to base 16. Deck 28 is formed from a structural material 30 that provides a stiffener for base 16, and can be made of material that is the same as or different from material 24. In the preferred embodiment, deck 28 is made of molded thermoplastic material. More traditional materials can be used including wood and thermo-setting materials. The upper surface of deck 28 is referred to as a top 32 or exposed surface 32. In the preferred embodiment, material 30 is bonded to material 24 through the use of adhesives or the like. Furthermore, material 30 can be extruded through holes 26 to form an extrusion 34 extending through holes 26. Extrusion 34 overlaps material 24, thus locking material 30 to material 24.

Figure 1:
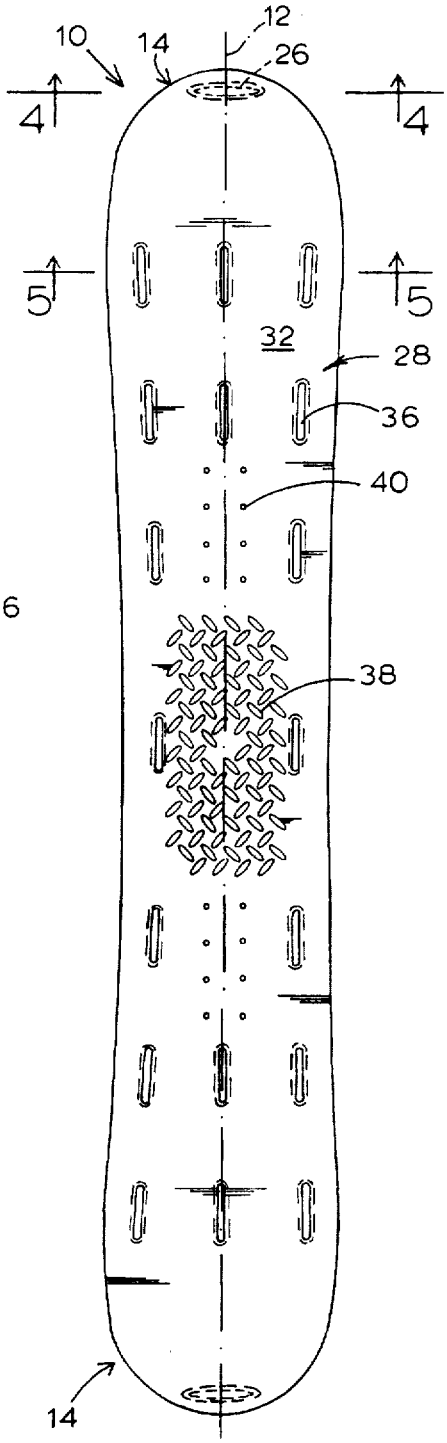
FIG. 1 is a top plan view of the snowboard of the present invention.
Figure 3:
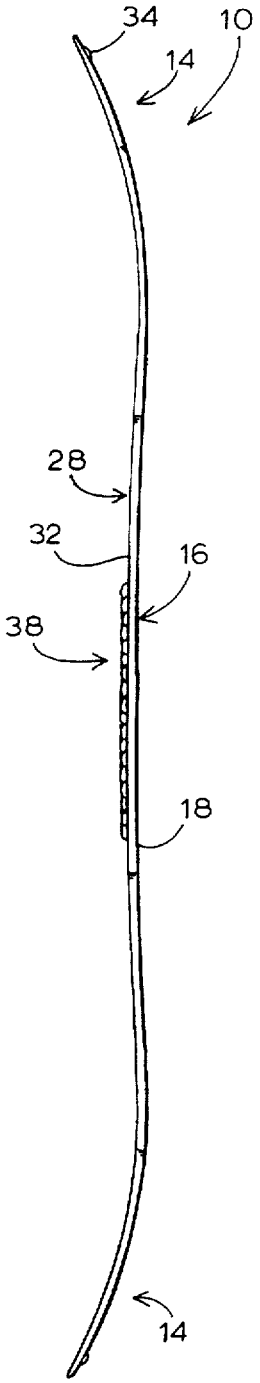
FIG. 3 is a left side elevation of the snowboard shown in FIG. 2.

In the preferred embodiment, indentation 36 is formed in top 32. Indentation 36 is preferably an elongated indentation substantially aligned with long axis 12 of snowboard 10. Thus, indentation 36 provides structural stiffness to snowboard 10. As shown in FIG. 1, plural indentations 36 can be provided and spaced along snowboard 10 to provide selective stiffening. In the preferred embodiment, plural indentations 36 are arranged in spaced rows, so that there are reinforced and non-reinforced portions of snowboard 10.

Additional features of snowboard 10 include a molded step plate 38 providing an area of improved traction formed in deck 28. In addition, a binding mounting plate pattern 40 can be molded into deck 28 to provide reference points for mounting bindings (not shown) to snowboard 10.

Figure 6:
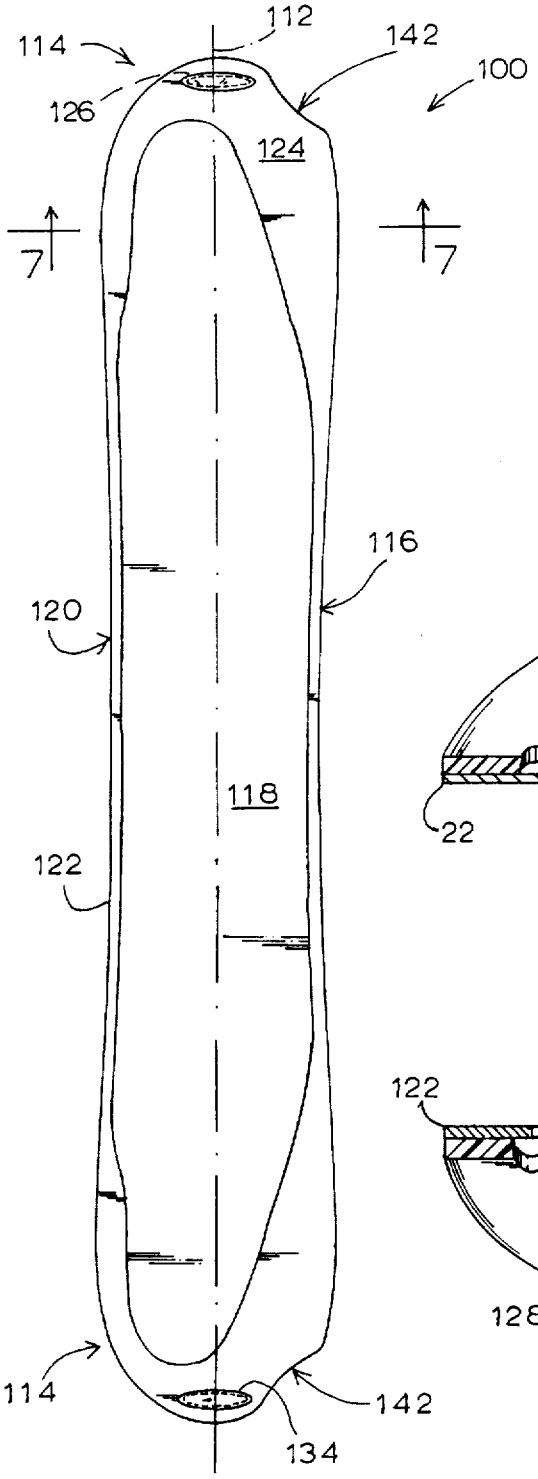
FIG. 6 is a bottom plan view of an alternative embodiment of the snowboard of the present invention in which only a portion of the surface area of the base of the snowboard is covered with a tunable material and concave radii are formed in the ends of the snowboard.
Figure 4:
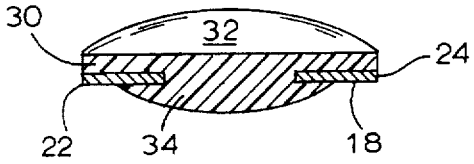
FIG. 4 is an enlarged cross-sectional view of the snowboard shown in FIG. 1, taken generally along the line 4—4 in FIG. 1.
Figure 5:
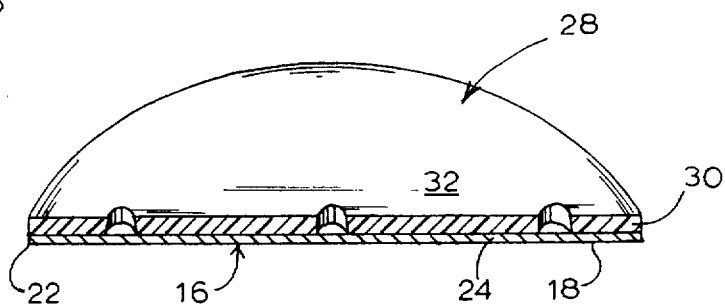
FIG. 5 is a cross-sectional view of the snowboard shown in FIG. 1, taken generally along the line 5—5 in FIG. 1, and generally on the same scale as that chosen for FIG. 4.
Figure 7:
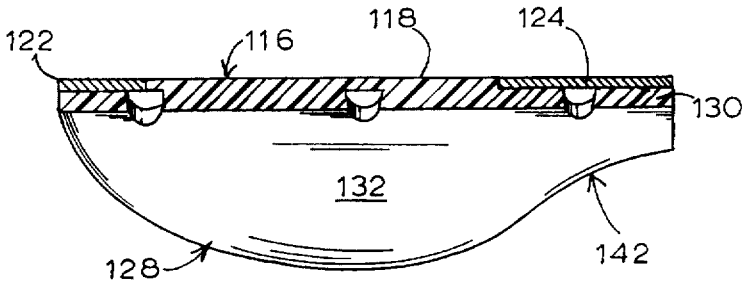
FIG. 7 is an enlarged cross-sectional view of the snowboard shown in FIG. 6, taken generally along the line 7—7 in FIG. 6.

An alternative embodiment of the invention is shown in FIGS. 6 and 7. The snowboard of the alternative embodiment is indicated generally at 100, and includes a long axis 112, ends 114 and a base 116 having a surface area defined by a bottom 118. Bottom 118 can also be referred to as a travelling surface or exposed surface of base 116. Bottom 118 has an outer perimeter 120 defined by an edge 122. Tunable material 124 forms a portion of bottom 118, preferably covering at least 10-percent of the surface area of bottom 118. Tunable material 124 can also be referred to as a sheet, and is preferably brushed stainless steel approximately 0.012-inches in thickness. Plural, oval-shaped holes 126 are provided in sheet 124 adjacent each end of the finished snowboard 100.

The remaining features of snowboard 100 of the alternative embodiment are similar to those of snowboard 10 of the preferred embodiment. Thus, snowboard 100 includes a deck 128 formed of structural material 130, and has a top 132. An extrusion 134 is extruded through holes 126 to bond material 130 to material 124. Plural, spaced elongated indentations (not shown) are substantially aligned with the long axis of snowboard 100. A molded step plate (not shown) and a binding mounting plate pattern (not shown) are also provided. The ends of snowboard 100 are shown with optional concave radii 142.

From the foregoing, it will be appreciated that what has been described is a tunable snowboard in which the base of the snowboard has a perimeter that can be formed to meet the specific needs of the end user. Thus, the snowboard has a traveling surface with perimetric edge tunability. In the preferred embodiment, the edge substantially resists wear and tear and can be repeatedly reshaped and resharpened to substantially redefine the perimeter of the traveling surface. For example, the controlling edges can be redefined to have a different side-cut radius, or to include concave radii near the ends of the snowboard.

In the preferred embodiment, this tunability is provided by a sheet of tunable material that covers substantially all of the base. In alternative embodiments, the tunable material covers only a portion of the base, the width of coverage being selected to provide the amount of reshapability of the perimeter desired in portions of the particular embodiment. For example, as shown in FIG. 6, more of base 116 may be covered adjacent ends 114 than in the remaining portions of snowboard 100. Also, the requisite tunable material could take a partial form, bonded to, and extending along the opposite undersides of the base.

As has been mentioned, the present invention also involves a method for making a snowboard 10. The method includes steps of providing tunable material 24 in the approximate shape of a snowboard 10. Tunable material 24 should be shaped to cover at least 10-percent of the surface area of the base of the finished snowboard. A deck 28 of structural material is formed to conform to the outer perimeter of the tunable material 24, and deck 28 is bonded to the tunable material 24. The method can include the additional steps of cutting a hole 26 in tunable material 24 adjacent an end 14 of finished snowboard 10 and then extruding a portion of the deck material through the hole. This step provides a better bonding of deck 28 to base 16. A plurality of spaced elongated indentations 36 can be molded in deck 28 to be substantially aligned with long axis 12 of snowboard 10. A step plate pattern 38 and a binding mounting plate pattern 40 can be molded into deck 28 to provide improved traction and reference points for mounting bindings, respectively.

In the preferred manner of practicing the invention, base 16 is first formed from 0.012-inch thick brushed stainless steel, and then deck 28 is molded in place on base 16. The molding process includes the steps of forming extrusion 34, plural indentations 36, step plate 38 and mounting plate pattern 40 as part of a single molding step.

INDUSTRIAL APPLICABILITY

The invented snowboard is applicable in any situation in which a tunable snowboard is desired to allow precise shaping of the snowboard to meet the needs of an end user.

While a preferred embodiment of the invented snowboard, and a practice method, have been disclosed, changes and modifications can be made without departing from the spirit of the invention.

I claim:

1. A snowboard comprising:

a base having a base surface area and including a sheet of tunable material substantially coextensive with the perimeter of the snowboard and covering at least 10-percent of the surface area of the base; and a deck of structural material attached to the base, and including a portion extruded through a hole which is provided in the base.

2. The snowboard of claim 1, wherein the sheet is metal.

3. The snowboard of claim 1, wherein the sheet covers substantially all of the surface area of the base.

4. A snowboard comprising:

a base having a base surface area and including a sheet of tunable material extending at least partially along the perimeter of the snowboard and covering a selected-percentage portion of the surface area of the base; and a deck of structural material attached to the base;

said sheet being provided with a hole through which a portion of the deck material is extruded.

5. A snowboard comprising:

a base having a base surface area and including a sheet of tunable material extending at least partially along the perimeter of the snowboard and covering a selected-percentage portion of the surface area of the base; and a deck of structural material attached to the base;

said sheet being provided with plural holes through which portions of the deck material are extruded.

6. The snowboard of claim 4, wherein the sheet has a bottom which is partially covered by the extruded deck material.

7. The snowboard of claims 1, 3, 4, or 5, wherein the sheet is brushed stainless steel with a thickness ranging from about 0.005-inches to about 0.035-inches.

8. A snowboard comprising:

a base substantially formed of a sheet of tunable material; and a deck of structural material attached to the base, and including a portion extruded through a hole which is provided in the base.

9. The snowboard of claim 8, wherein the sheet is metal.

10. The snowboard of claim 8, wherein the hole is located adjacent an end of the snowboard.

11. The snowboard of claim 8, wherein the deck comprises a plurality of spaced elongated indentations.

12. The snowboard of claim 11, wherein the spaced elongated indentations are substantially aligned with the long axis of the snowboard.

13. The snowboard of claims 8, 10, 11 or 12, wherein the sheet is about 0.012-inch thick stainless steel.

14. A method of making a snowboard comprising:

the step of providing tunable material to create a first element having an outer perimeter and a shape approximately that of a snowboard, and with this element including at least one hole;

the step of forming a deck of structural material at least partially conforming to the outer perimeter of the first element, and including a portion extruded through the first element's hole; and the step of bonding the deck to the first element to create a finished snowboard having a base at least partially defined by the outer perimeter of the first element, with the base having a surface area and with the tunable material covering a selected-percentage portion of the surface area of the base.

15. The method of claim 14 further comprising the step of forming in the deck a plurality of spaced elongated indentations that are substantially aligned with the long axis of the snowboard.

16. A snowboard comprising:

a deck of structural material; and a tunable member joined to the underside of said structural material, said tunable member including a hole through which a portion of said structural material is extruded.

* * * * *